United States Patent [19]

Kronholm

[11] Patent Number: 4,582,095

[45] Date of Patent: Apr. 15, 1986

[54] FABRIC MONITORING MEANS FOR POWER LOOMS

[75] Inventor: Rolf Kronholm, Löddeköpinge, Sweden

[73] Assignee: ASEA Aktiebolag, Västerås, Sweden

[21] Appl. No.: 658,042

[22] Filed: Oct. 5, 1984

[30] Foreign Application Priority Data

Oct. 7, 1983 [SE] Sweden ..... 8305527

[51] Int. Cl.[4] ..... D03D 49/00

[52] U.S. Cl. ..... 139/1 R; 139/291 R

[58] Field of Search ..... 139/1 R, 291 R; 382/1; 364/470; 112/121.11

[56] References Cited

U.S. PATENT DOCUMENTS

| | | | |
|---|---|---|---|
| 2,654,288 | 10/1953 | Savadelis | 139/1 R |
| 3,983,370 | 9/1976 | Caspi | 364/470 |
| 4,146,061 | 3/1979 | Gotoh | 139/1 R |
| 4,344,146 | 8/1982 | Davis | 382/1 |
| 4,494,203 | 1/1985 | Suzuki | 364/470 |

*Primary Examiner*—Henry S. Jaudon

*Assistant Examiner*—Steve Shongut

*Attorney, Agent, or Firm*—Watson, Cole, Grindle & Watson

[57] ABSTRACT

A power loom for the manufacture of woven fabrics, in particular woven wire fabrics and felts for use in paper-making machines, is provided with a computerized pattern recognition system for monitoring the warp, the fabric, the edge of the fabric, the density of the weft, and so on. The device includes a video camera and computerized image processing means. By analyzing a picture taken near an edge of the fabric, digital information concerning the position of the edge of the fabric, the weft density, and so on, can be obtained. The digital information is adapted to be used in an open or closed control system for positioning the edge of the fabric in correct position, after an interruption of fabric through the loom, before a restart of the fabric feed. Digital information concerning the actual weft density can be utilized as the actual value in a weft density control system using the driving means of the warp beam of the loom as the executive members via a tensile stress control applied to the fabric.

9 Claims, 6 Drawing Figures

1
2
3
4
5
6
7
8
9
10
11
12
13
14
15
16
17
D
CPR
A/D
MR
VK
Ls

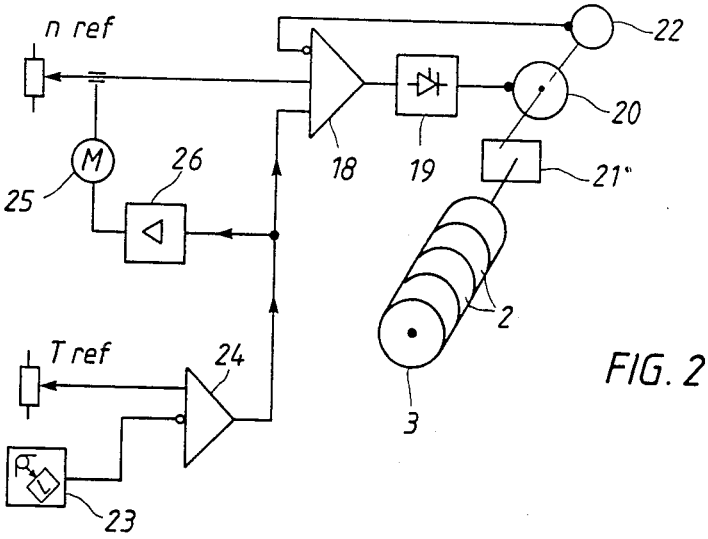
FIG. 2
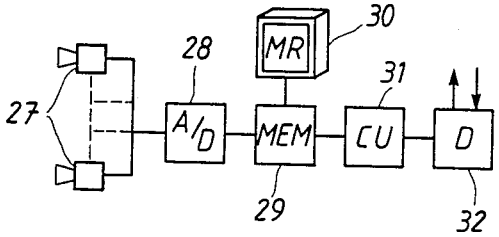
FIG. 3
FIG. 4
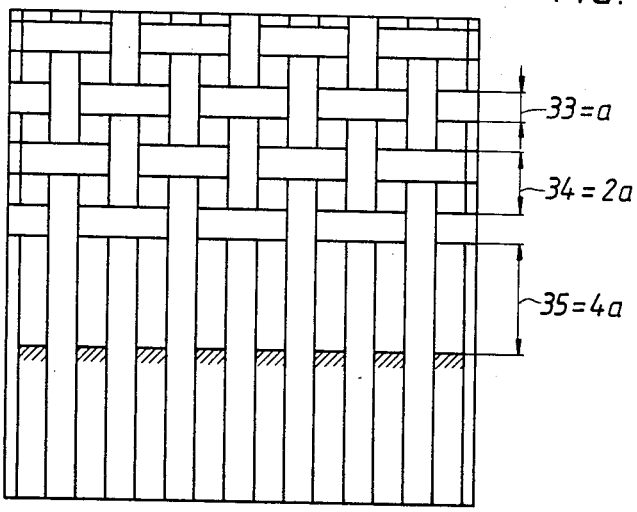

FABRIC MONITORING MEANS FOR POWER LOOMS

BACKGROUND OF THE INVENTION

1. Field of the invention

This invention relates to a device for monitoring a warp and a fabric in a power loom, in particular, but not exclusively, a loom for the weaving of wires and felts for, primarily, paper-making machines.

2. Description of the Prior Art

To facilitate an understanding of the prior art and the problems associated with such weaving, the structure of a power loom used in that connection will first be described with reference to FIG. 1 of the accompanying drawings, which is a schematic view of a power loom.

Referring to FIG. 1, the longitudinal yarns, which pass through the loom to form the warp 1, are unwound from bobbins 2 which usually have an axial length of from 2 to 5 dm. The bobbins 2 are mounted on a warp beam 3, the axial length of which determines the maximum width of the woven fabric. The width of the loom is from 10 to 20 m, but looms for a maximum width of 30 m are currently being manufactured. The yarn diameter in the case of weaving wire fabric is normally of the order of magnitude of from 0.15 to 0.35 mm. The yarn density in the warp 1 normally amounts to about 25 ends per cm.

The warp 1 passes over an auxiliary back roll 4 and a movably mounted whip roll 5, and then to a dobby, which comprises a shaft frame 6 with a heald 7. The task of the dobby is alternately to raise and lower every second warp yarn in order to form a shed 8 to make room for the transverse passage or picking of a shuttle 9 with weft yarn between the upper and lower layers of warp yarns of the shed 8. The shuttle 9 rests on a shuttle race 10 at the level of the lower layer of warp yarns of the shed 8. A reed 11, which is a yarn controlling device with a slot or groove for each warp yarn, is secured to the shuttle race 10, the shuttle race and the reed being mounted on an arm 12 which is pivotally mounted at its lower end.

After a weft yarn has been picked by the shuttle 9 between the upper and lower layers of warp yarns of the shed 8, the upper part of the arm 12 moves in the longitudinal direction of the loom, with the result that the weft yarn that has just been inserted is beaten by the reed 11 with great force against the previously inserted weft yarns. At this point the warp 1 changes into a fabric 13, which passes on over a breast beam 14 to a number of fabric beams 15, 16 and 17, and thence to a final take-up beam (not shown) for the finished woven fabric.

The feeding speed of the warp 1 and the fabric 13 during normal operation amounts to about 0.5 to 5 cm/min. The shuttle 9 is picked with great force, and the number of picks per minute depends on the weaving width of the loom. The weft density for one and the same weaving speed can be selected by means of different gear ratios between the central driving means and the driving means of the fabric beams. Normally the weft density is from 15 to 50 yarns/cm of fabric.

Looms of the above-described type are driven in one of two ways. The first and older of the two ways involves the provision of a main drive which drives the fabric beams 15, 16 and 17, so that the warp 1 and the fabric 13 are pulled forwardly through the loom. From this main drive, the dobby, the arm 12 with the shuttle race 10 and the reed 11, the picking mechanism for the shuttle 9 and other mechanisms of the loom are activated by means of different auxiliary mechanisms. The warp beam 3 is mechanically braked.

The second way of driving such looms, which is used when there are greater demands on the shape of the fabric, is similar to the first way, but involves the replacement of the mechanical braking device of the warp beam 3 by an electrical braking device. This electrical braking device comprises a d.c. drive means which is part of a warp tension control system. Since the present invention is concerned primarily with looms driven in this second way, the driving system will now be described in more detail with reference to FIG. 2 of the accompanying drawings, which is a schematic diagram of the driving system.

Referring to FIG. 2, the means which carries out the tension control includes a conventional speed control arrangement designated nref, a speed regulator 18, a static convertor 19, a motor 20 with a gear unit 21, and a tachometer 22 for feedback. The gear ratio of the gear unit 21 is very high, which means that the motor 20 with the gear unit 21 is self-locking. The tension control is superordinate to the speed control. The tension is measured by a load cell 23 situated at the breast beam 14 (see FIG. 1). The desired tension is set by a tension reference Tref, and the output of the tension regulator 24 is supplied to the speed regulator 18 as an additional reference.

The circumferential speed of the warp beam 3 must correspond substantially to the speed at which the driving means of the fabric beams draws the fabric forwards. As the yarn is unwound from the bobbins 2, the rotational speed of the warp beam 3 must therefore be adjusted to adapt to the feeding speed of the fabric. In principle, this adjustment could be performed by the addition of the tension control fault to the speed reference. However, it is desirable for the tension regulator to operate with zero mean fault, and, moreover, it is highly desirable to be able to start up the loom with the correct speed on the warp beam after a stoppage. The tension fault signal is therefore utilized for continuously increasing or decreasing the speed reference via a motor operating device 25 and a readjustment device 26, so that the tension fault regulator may operate around zero.

The prior art regarding the control of the warp, the fabric, the weft density, etc., at present involves a sporadic inspection of the fabric with a magnifier and a ruler or with a microscope.

In a perfect fabric there is the same distance between the yarns, or possibly a regularly recurring pattern. Thus, a constant weft density is aimed at. If the fabric is an endless wire for a paper-making machine, disturbances and irregularities in the weft density may affect the quality of the paper made on the finished wire, with respect to marks as well as the thickness of paper produced. Disturbances of the weft density may also initiate wire breakage with considerable economic consequences.

For technical reasons, a direct control of the weft density has not been possible in the past, among other things because of the unavailability of measuring equipment for sensing the weft density. A great improvement in the quality and uniformity of the fabric was obtained with the introduction of tension control, as shown in FIG. 2, as compared with the corresponding control in connection with mechanical braking of the warp beam. However, the tension control still only constitutes an indirect control of the weft density.

A power loom of the kind described above is a relatively compact structure, which implies that a continuous monitoring of the fabric during operation is at present not feasible in practice. If an irregular weft density or other fault occurs, it may be difficult to discover this quickly enough. The consequence of this is that quite a long piece of fabric can be produced before the irregularity can be observed. The fabric feed must then be stopped, and the incorrect weft yarns must be removed. The warp and the fabric must then be moved backwards so that the new edge of the fabric assumes the correct position for insertion of a new weft yarn.

In the case of yarn breakage in connection with picking of the shuttle through the shed, driving of the loom is stopped. When the weaving is restarted after the broken yarn has been removed and a new shuttle has been prepared, a variation in weft density often occurs in the fabric due to the position of the edge of the fabric (weft edge) having been changed during the interruption. This is due to the fact that the yarn material is elastic and ductile and to the fact that, when the loom remains stationary under tension for a period of time, the warp is stretched and to a certain extent the warp is straightened out between the weft yarns in the fabric. Therefore, the weft edge is displaced and this results in an undesirable variation in weft density in the fabric.

The movement of the weft edge when the loom has stopped is at present a considerable problem, since accurate determination of the position during a stoppage and immediately prior to restart cannot be performed using known measuring techniques applied to such looms.

As will be clear from the above description of the prior art and the problems connected therewith, a measuring device which is able to indicate with sufficient accuracy the position of the weft edge and the weft density could be utilized for correctly positioning the weft edge after an interruption of the driving of the loom, for monitoring the fabric, and also for inspection and control of the weft density.

SUMMARY OF THE INVENTION

According to the invention, a device for monitoring a warp and a fabric in a power loom and for positioning a weft edge of the fabric, comprises a video camera arranged to generate electrical signals which define a picture of the warp and the fabric adjacent a weft edge, means for supplying said electrical signals to a pattern recognition member for presentation of the picture on a monitor for analysis of the picture for monitoring purposes, and means for using the picture shown on the monitor, after an interruption of fabric feed, for positioning the weft edge to a predetermined position with the aid of driving means of a warp brake included in the loom, or by a separate driving device, before a restart of the fabric feed.

A computerized pattern recognition (CPR) system has been available on the market for some time. This is an image processing system which can replace the eyes of an operator by means of video and computer techniques. Measuring, sorting, inspection, identification, etc., of different patterns or objects can be performed by means of this system. The device according to the invention utilizes a CPR system as a measuring device and with the aid of said system the device is able (a) to position the weft edge in the correct position after feed of the fabric has been interrupted via open or closed control, (b) to obtain a good monitoring of the warp, the fabric and the weft density, and (c) to influence the weft density via open or closed control. By employing the CPR system for positioning the weft edge, monitoring the warp, the fabric and the weft density and regulating the weft density, problems such as varying positions of the weft edge in the event of interruption of the fabric feed, a varying weft density, and difficulties in monitoring, can be overcome.

In one embodiment of the device according to the invention, the picture, which is supplied to the pattern recognition member via the video camera, is analyzed with respect to the position of the weft edge relative to a reference position, and the pattern recognition member delivers a signal corresponding to the distance to said reference position, which signal is adapted to constitute an actual value in a weft edge positioning control system.

In another embodiment of the device according to the invention, the picture, which is supplied to the pattern recognition member via the video camera, is analyzed with respect to the weft density of the fabric, and the pattern recognition member delivers a signal corresponding to the mean weft density for a number of weft yarns, which signal is adapted to constitute an actual value in a weft density control system.

In yet another embodiment of the device according to the invention, the picture, which is supplied to the pattern recognition member via the video camera, is analyzed with respect to the appearance of both the warp and the fabric for comparison with a reference picture corresponding to the correct warp and fabric pattern and, when a permissible deviation is exceeded, for indicating this or, alternatively, delivering a stop signal to stop feed of the fabric.

BRIEF DESCRIPTION OF THE DRAWINGS

The invention will now be described, by way of example, with reference to the accompanying drawings, in which:

FIG. 2 is a schematic diagram of a driving system and weave tension control system for the loom of FIG. 1, FIG. 3 is a diagram showing the fundamental features of a CPR system, FIG. 4 shows a picture of the warp and the fabric, presented on the monitor, adjacent to a weft edge.

DESCRIPTION OF PREFERRED EMBODIMENTS

Figure 1:
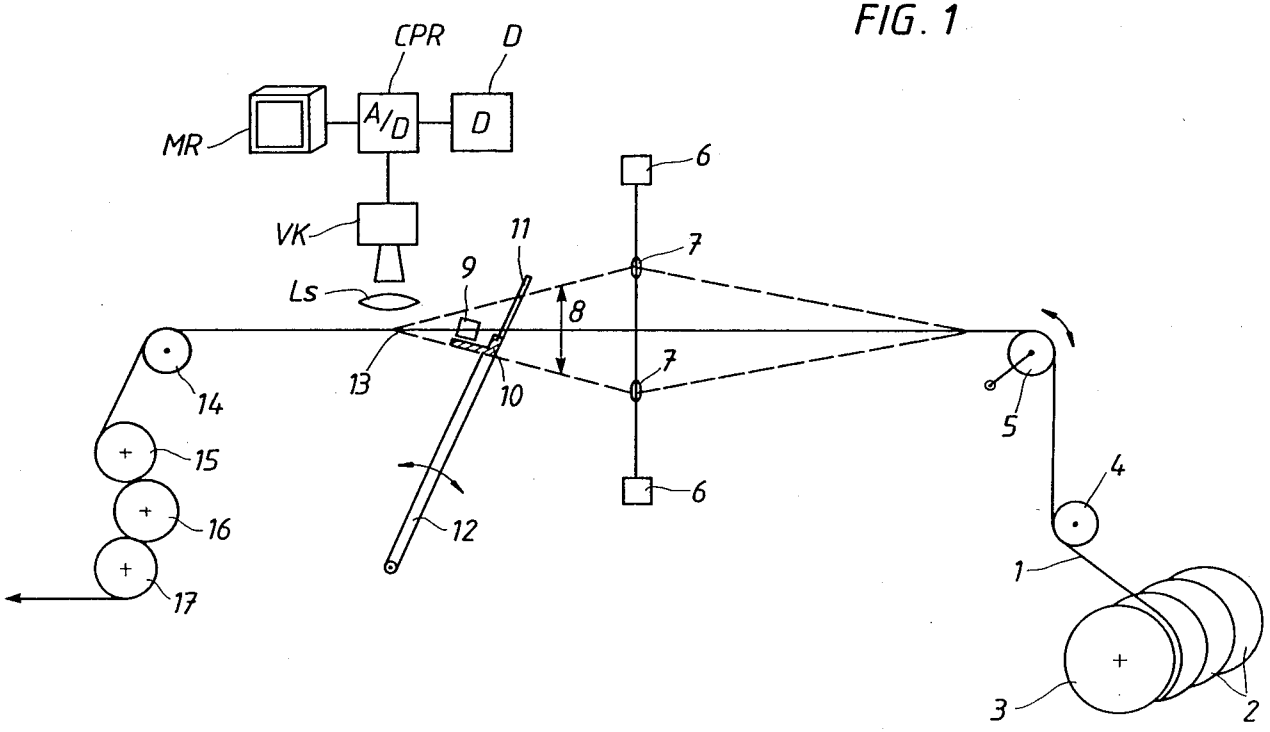
FIG. 1 is a schematic view of a power loom provided with a video camera and a monitor.

Referring to FIG. 1, the items designated with the numerals 1–17 have already been described above in the discussion of the prior art. In addition, this Figure shows that the loom is provided with a video camera VK and a lens system Ls positioned adjacent to the edge of the fabric 13. With the aid of the video camera and the lens system, it is possible to obtain a greatly enlarged picture of the fabric 13 and the weft edge, presented on a monitor MR.

FIG. 2 has already been described above, in connection with the discussion of the prior art. FIG. 3 shows the arrangement of a CPR system for employment with the loom of FIG. 1. In this Figure, the picture information from an optional number of video cameras 27 is transmitted to an A/D convertor 28, which converts an analog picture into digital data corresponding to a plurality of levels on a grey scale. The digital data is transmitted to an image memory 29 which is divided into a large number of dots on a bar pattern. In a CPR system available on the market, the screen can be divided into a bar pattern consisting of 512×512 picture elements or pixels. Via the image memory 29, the picture taken by the video cameras 27 can be presented on the monitor or TV screen 30. In a central unit (CU) 31 and a digital unit (D) 32, a computerized processing of the picture takes place according to the current information of the system, and the desired data, for example the position of the weft edge and the weft density, is given in digital form. By suitably programming the computer, digital information about the position of the weft edge, about the distance between the weft yarns, about the mean distance value for a certain number of weft yarns, etc., can be obtained.

A picture of the fabric near a weft edge, suitably enlarged, may have the appearance shown in FIG. 4. The determination of the weft density and the position of the weft edge will be a trivial problem, as will be seen. In FIG. 4, the yarn diameter 33 is, for example, a mm, and thus the yarn distance or the weft density 34 is equal to 2a mm and the distance of the weft edge from a reference position 35 is equal to 4a mm.

To prevent a variation in weft density in the event of an interruption of the forward feed of the fabric through the loom, two different methods are available, namely open and closed control of the weft edge to the correct position.

The open control method means that, starting from the monitor picture, for example according to FIG. 4, an operator influences the driving means of the warp beam 3 (see FIG. 1) and the fabric beams 15–17 so that the weft edge is moved to the correct position, which can be verified by looking at the monitor.

Figure 5:
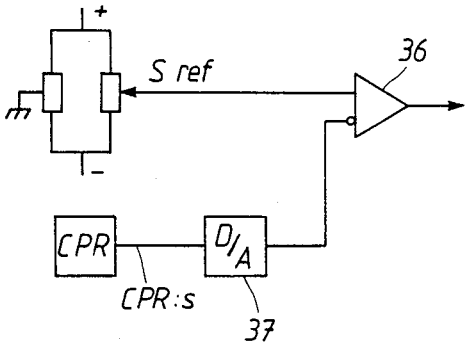
FIG. 5 is a diagram of a control circuit for a closed weft edge positioning system.

The closed control method means that the positioning of the weft edge takes place with the aid of a closed position control system, which in principle can be arranged as shown in FIG. 5. In this Figure, a polarized position reference sref is supplied to a position regulator 36. From the CPR measuring equipment there is obtained a digital signal CPR:s corresponding to the position of the weft edge relative to a reference position. In the analog control system shown in FIG. 5, the digital signal is converted in the D/A convertor 37 into a corresponding analog signal which is used as the actual value in the control system. The output signal of the position regulator may have the driving means of the warp beam 3 and the fabric beams 15–17 as executive members, as in the open control method.

Other embodiments, as for example digital position control, position control with the aid of a stepping motor applied to the warp beam or the fabric beams, may also be used. The stepping motor arrangement could also be used in the open control method.

During normal operation of the loom, the position control system is cut off.

The ability of the CPR system to compare the current picture from the video camera with a picture stored in the memory can be utilized for monitoring both the warp and the fabric. A pattern, for example corresponding to a pattern picture according to FIG. 4, can be stored in the memory. If the current picture shows deviations from the given reference picture, the CPR system can stop the fabric feed via the digital output. The reference pictures of different patterns can be stored in the CPR memory. Depending on the pattern in question, a certain part of the memory is activated.

As will be clear, the CPR system permits the possibility of controlling and measuring the weft density. This property may be part of the pattern recognition for stopping the fabric feed in case of too great a deviation from a given weft density, and it may be included as a separate task for controlling the weft density.

The control of the weft density implies that, in the computerized processing of the picture, the CPR system calculates the weft density and compares this value with a reference value present in the memory. Upon a deviation exceeding a permissible variation, a warning signal to that effect is released, or an order to stop the feed of the fabric is given.

Figure 6:
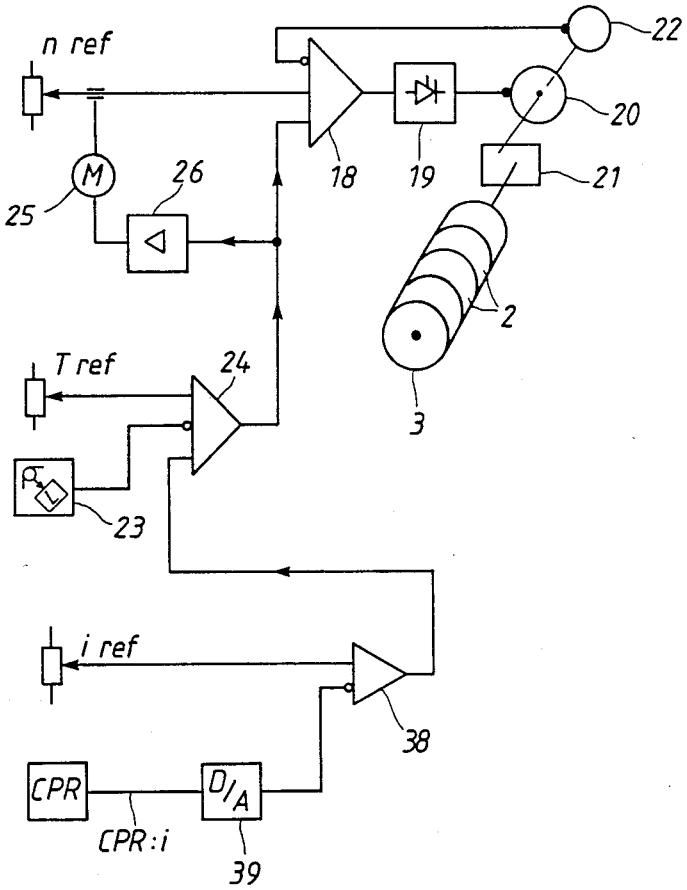
FIG. 6 is a diagram of a weft density control system.

The weft density control presupposes that the CPR system emits a digital signal corresponding to the weft density in question, measured over a given number of weft yarns. An example of the embodiment of a weft density control system is shown in FIG. 6. In this Figure, iref constitutes a reference value for the desired weft density, which value is supplied to a weft density regulator 38. The weft density CPR:i in question in digital form is converted in the D/A convertor 39 into an analog signal and is supplied to the regulator 38 as an actual value. The members carrying out this operation may consist of the tension control arrangement described above as prior art. Such a solution may be formed in such a way that the output signal of the weft density regulator 38 is supplied to the tension regulator 24 as an additional reference.

Other embodiments may also be employed; for example, the driving means of the fabric beams may be utilized.

It should be pointed out that a weft density control according to the method described will only be used for fine adjustment of the weft density. Coarse adjustment, as stated previously, is intended to be performed by selection of the gear ratio between the driving means of the fabric beams and the arm 12 according to FIG. 1.

What is claimed is:

1. A device for monitoring a warp and a fabric in a power loom and for positioning a weft edge of the fabric, comprising:

a video camera arranged to generate electrical signals which define a picture of the warp and the fabric adjacent a weft edge, pattern recognition means for presentation of said picture on a monitor for monitoring purposes, and said pattern recognition means includes means for generating control signals from said picture, after an interruption of the fabric feed through the loom, for positioning the weft edge to a predetermined position before a restart of the fabric feed.

2. A device according to claim 1, further comprising driving means for positioning the weft edge to a predetermined position, and wherein said driving means drives a warp brake included in said power loom.

3. A device according to claim 1, further comprising means responsive to the generated control signals for positioning the weft edge to a predetermined position.

4. A device according to claim 3, wherein said means responsive to the control signals for positioning the weft edge to a predetermined position includes the driving means of a warp brake included in said power loom.

5. A device according to claim 3, wherein said means responsive to the control signals for positioning the weft edge to a predetermined position includes a driving means separate from the driving means for other components of said power loom.

6. A device according to claim 5, wherein said means for generating control signals includes means for analyzing said picture with respect to the position of the weft edge relative to a reference position, and said control signals correspond to the distance to said reference position and are adapted to constitute actual weft edge positioning signals.

7. A device according to claim 5, wherein said means for generating control signals includes means for analyzing said picture with respect to the weft density of the fabric, and said control signals correspond to the mean weft density for a number of weft yarns and are adapted to constitute actual weft density values.

8. A device according to claim 5, wherein said means for generating control signals includes means for analyzing said picture with respect to the appearance of both the warp and the fabric for comparison with a reference picture corresponding to the correct warp and fabric pattern, and said device further comprising means for indicating that a permissible deviation has been exceeded.

9. A device according to claim 5, wherein said means for generating control signals includes means for analyzing said picture with respect to the appearance of both the warp and the fabric for comparison with a reference picture corresponding to the correct warp and fabric pattern, and said device further comprising means for providing a stop signal to stop the feed of the fabric.

* * * * *